US006938988B2

(12) United States Patent
Clark et al.

(10) Patent No.: US 6,938,988 B2
(45) Date of Patent: Sep. 6, 2005

(54) COUNTER-BORE OF A FLUID EJECTION DEVICE

(75) Inventors: Garrett E. Clark, Albany, OR (US); Michel Macler, Corvallis, OR (US); Curt Nelson, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 146 days.

(21) Appl. No.: 10/361,352

(22) Filed: Feb. 10, 2003

(65) Prior Publication Data

US 2004/0155928 A1 Aug. 12, 2004

(51) Int. Cl.[7] ..... B41J 2/05; B41J 2/14; B41J 2/16

(52) U.S. Cl. ..... 347/47; 347/65

(58) Field of Search ..... 347/47, 65

(56) References Cited

U.S. PATENT DOCUMENTS

| | | | | |
|---|---|---|---|---|
| 4,550,326 A | | 10/1985 | Allen et al. | |
| 4,675,083 A | | 6/1987 | Bearss et al. | |
| 4,791,436 A | | 12/1988 | Chan et al. | |
| 4,829,319 A | | 5/1989 | Chan et al. | |
| 4,967,208 A | | 10/1990 | Childers | |
| 5,305,015 A | | 4/1994 | Schantz et al. | |
| 5,451,993 A | * | 9/1995 | Takahashi et al. | 347/47 |
| 5,992,968 A | * | 11/1999 | Uetsuki et al. | 347/37 |
| 6,130,688 A | | 10/2000 | Agarwal et al. | |
| 6,176,571 B1 | | 1/2001 | Kishima et al. | |
| 6,527,370 B1 | | 3/2003 | Courian et al. | |

FOREIGN PATENT DOCUMENTS

| | | |
|---|---|---|
| EP | 0337429 A2 | 10/1989 |
| EP | 0352468 | 1/1990 |
| EP | 0495663 | 7/1992 |
| EP | 0770487 | 5/1997 |
| EP | 0787588 | 8/1997 |
| EP | 0792744 | 9/1997 |
| EP | 0835759 A1 | 10/1997 |
| JP | 10-175299 | 6/1998 |

OTHER PUBLICATIONS

Internet article; http://www.fortunecity.com/athena/thatcher/2042/Veterans_m.htm.*

Internet article; http://the insidegroove.com/tracks/nascar-–winston–nextel–cup–tracks.php4.*

Copy of PCT Search Report dated Nov. 28, 2000.

* cited by examiner

*Primary Examiner*—Michael S. Brooke

(57) ABSTRACT

A fluid ejection device comprises a substrate including a fluid ejector thereon, and an orifice member positioned over said substrate. The orifice member has a fluid-transfer bore extending therethrough and corresponding to the fluid ejector. The orifice member further has a counter-bore about the fluid-transfer bore.

34 Claims, 5 Drawing Sheets

COUNTER-BORE OF A FLUID EJECTION DEVICE

FIELD OF THE INVENTION

The present invention relates to fluid ejection devices, and more particularly to a counter-bore of a fluid ejection device.

BACKGROUND OF THE INVENTION

Various inkjet printing arrangements include both thermally actuated printheads and mechanically actuated printheads. Thermally actuated printheads tend to use resistive elements or the like to achieve ink expulsion, while mechanically actuated printheads tend to use piezoelectric transducers or the like.

A representative thermal inkjet printhead of a print cartridge has a plurality of thin film resistors provided on a semiconductor substrate. A barrier layer is deposited over thin film layers on the substrate. The barrier layer defines firing chambers about each of the resistors, an orifice corresponding to each firing chamber, and an entrance or fluid channel to each firing chamber. Often, ink is provided through a slot in the substrate and flows through the fluid channel to the firing chamber. Actuation of a heater resistor by a "fire signal" causes ink in the corresponding firing chamber to be heated and expelled through the corresponding orifice.

In order to provide high print quality, each nozzle (or orifice) of the printhead should be able to repeatably deposit the desired amount of ink in the proper pixel location on a medium, producing round spots or dots. However, printhead aberrations and the effects of aging can adversely affect ink drop placement. The actual location of misplaced drops can visibly differ from the desired location, much like missing the bulls-eye of a target. The location error can have a component in the direction in which the print cartridge is scanned; such error is known as scan axis directionality ("SAD") error. The location error can also have a component in the direction in which the medium is advanced; such error is often called paper axis directionality ("PAD") error.

Another form of drop placement error also occurs because fluid is typically not ejected from a nozzle in the form of a single drop, but rather as a main drop followed by one or more satellite drops. All of these drops would ideally be deposited in the same pixel location; however, because the main and satellite drops are ejected at slightly different times with slightly different velocities, satellite drops often land downstream in the scan direction from the main drop. Instead of printing a round spot on the medium, non-coincident main and satellite drops can produce a non-round spot with a "tail", or even more than one spot on the medium. As the scanning speed of the printhead with respect to the medium increases, the time separation between the main and satellite drops has a greater effect, and it becomes more likely that the main and satellite drops will not result in round spots as desired.

Drop placement errors generally cause a visually significant print quality defect known as banding: strip-shaped nonuniformities that are visible throughout the printed image. Banding is particularly noticeable when the drop placement errors are not consistent from nozzle to nozzle on the printhead. Banding is also particularly noticeable when the drop placement errors for a single nozzle vary between consecutive drops, such as when the main and satellite drops sometimes coincide, but other times don't coincide. Furthermore, a combination of round and non-round spot shapes in an area on the medium which is intended to be printed with a uniform color and intensity can result in an undesirable variation of lightness and darkness within the supposedly uniform area. Accordingly, it would be desirable to deposit drops of fluid in a repeatably accurate and/or precise manner.

SUMMARY

A fluid ejection device comprises a substrate including a fluid ejector thereon, and an orifice member positioned over said substrate. The orifice member has a fluid-transfer bore extending therethrough and corresponding to the fluid ejector. The orifice member further has a counter-bore about the fluid-transfer bore.

DETAILED DESCRIPTION

Figure 1:
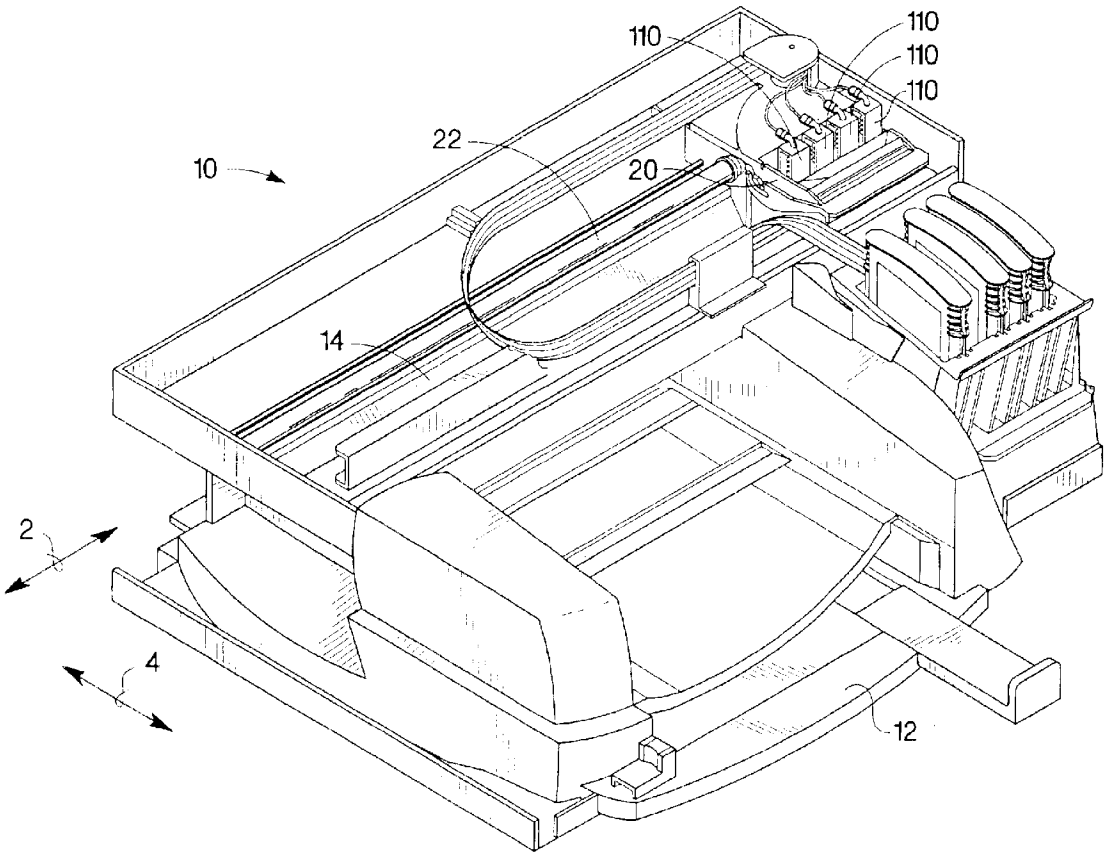
FIG. 1 is a perspective view of a printer according to an embodiment of the present invention.

Overview of A Fluid Ejection Device Embodiment

Referring now to the drawings, there is illustrated a fluid ejection system 10 constructed in accordance with an embodiment of the present invention and operated in accordance with an embodiment of a fluid ejection method which provides accurate and/or precise drop placement at high scanning speeds so as to minimize visual printing defects such as banding. The system 10 includes at least one ejection device 110 having ejection nozzle features which reduce drop placement error in the medium advance direction 4 (known as PAD error) and/or in the scan axis direction 2 (known as SAD error). In one embodiment, objectionable banding is minimized, thereby maximizing the quality of the output produced by the system 10.

The system 10 generally includes a frame 14 to which a carriage 20 is moveably mounted along a sliding rail 22. The carriage 20 is capable of holding one or more ejection devices 110 and moves them relative to the surface of a medium 18 such as paper transparency film, textiles, or any other medium. The medium is often placed in input tray 12. In this embodiment shown, the ink or fluid supply is separate from the ejection device 110. Embodiments of the present invention may use fluid supply that is separate from the ejection device as shown in FIG. 1, or fluid supply that is coupled with the ejection device within a cartridge, such as the cartridge 101 shown in FIG. 2.

Figure 2:
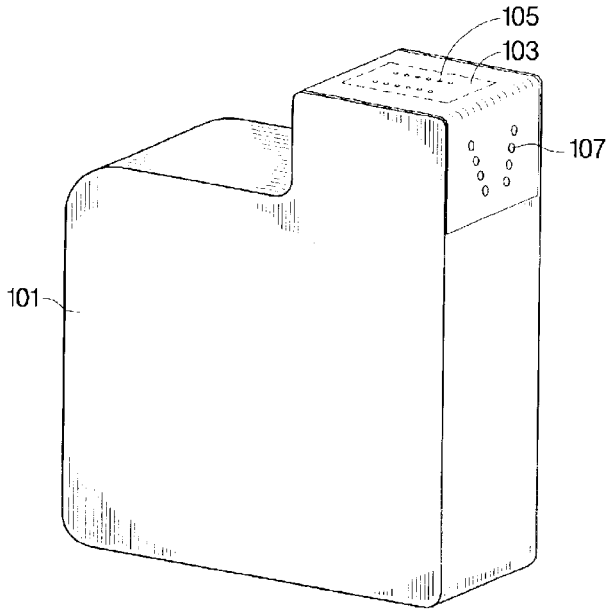
FIG. 2 illustrates a perspective view of an embodiment of a fluid ejection cartridge of the present invention.

FIG. 2 is a perspective view of an embodiment of a cartridge 101 having a fluid ejection device 103, such as a printhead. The cartridge houses a fluid supply, such as ink. In this embodiment, visible at the outer surface of the printhead are a plurality of bores, such as orifices or nozzles, 105 through which fluid is selectively expelled. In one embodiment, the fluid is expelled upon commands of a printer (not shown), which commands are communicated to the printhead through electrical connections 107.

Figure 3:
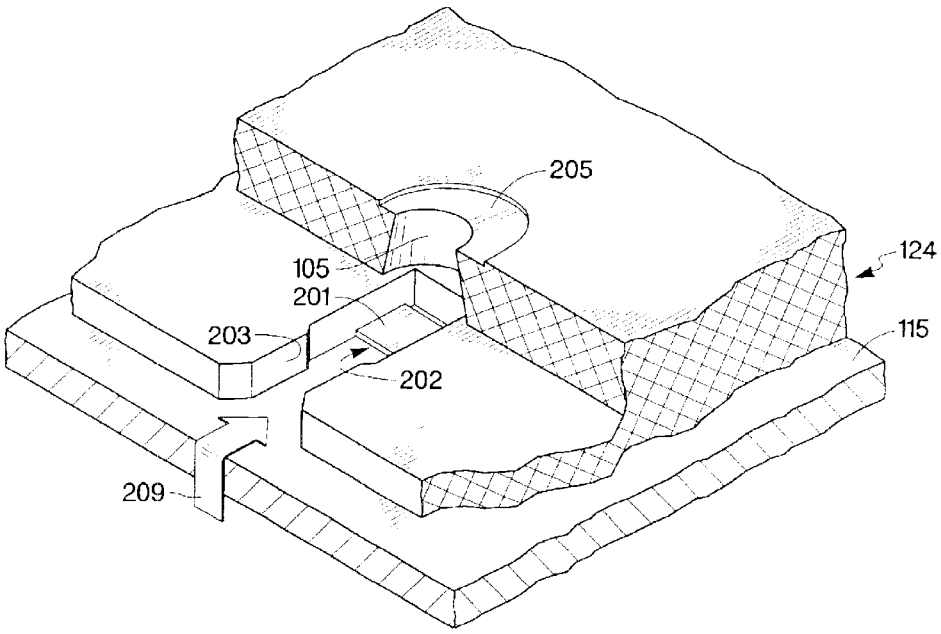
FIG. 3 is a perspective view of an embodiment of a fluid ejector.

In the embodiment of FIG. 3, a thin film stack 115 (such as an active layer, an electrically conductive layer, or a layer with micro-electronics) is formed or deposited on a front or first side (or surface) of a substrate. The thin film stack can include, in one embodiment, layers to form an ejection element 201, such as a fluid ejector, a resistor, a heating element, or a bubble generator.

In one embodiment, a top layer 124 is deposited over the thin film stack 115. In one embodiment, the top layer 124 is a layer comprised of a fast cross-linking polymer such as photoimagable epoxy (such as SU8 developed by IBM), photoimagable polymer or photosensitive silicone dielectrics, such as SINR-3010 manufactured by ShinEtsu™. In another embodiment, the top layer 124 is made of a blend of organic polymers which is substantially inert to the corrosive action of ink. Polymers suitable for this purpose include products sold under the trademarks VACREL and RISTON by E. I. DuPont de Nemours and Co. of Wilmington, Del. In yet another embodiment, the top layer 124 includes a polymer barrier layer defining firing chamber 202 and an orifice plate defining the corresponding orifice 105.

In a particular embodiment, the top layer 124 defines the firing chamber 202 where fluid is heated by the corresponding ejection element 201 and defines the corresponding nozzle orifice 105, such as a fluid-transfer bore, through which the heated fluid is ejected. Fluid 209 flows into the firing chamber 202 via a channel 203 defined by the top layer 124. Flow of a current or a "fire signal" through the resistor causes fluid in the corresponding firing chamber to be heated and expelled through the corresponding nozzle 105.

In one embodiment, the top layer 24 is an orifice member. The orifice member has a top surface that defines a top opening for the fluid-transfer bore. In one embodiment, the counter-bore 205 extends around the top opening for the fluid transfer bore 105. In another embodiment, a counterbore 205 is disposed in the outer surface of the layer 124 about the nozzle 105. In an inner surface of the layer 124, such as a bottom surface of the orifice member, is a bottom opening of the orifice 105. The bottom opening is adjacent the corresponding firing chamber.

In one embodiment, the fluid transfer bore 105 is substantially circular. The orifice 105 has a diameter "a" in a range of about 10 to 14 microns, in one particular embodiment about 12 microns, to its top edge 106. In another embodiment, the nozzle 105 is non-circular in shape. For this non-circular shape, the area of the counterbore is substantially similar to the range of circular areas.

Embodiments of Reduced Drop Placement Error

As will be explained subsequently in greater detail, the nozzles 105 and counter-bores 205 can be constructed with geometric features according to one of the present embodiments that reduce drop placement errors on a medium 18.

Figure 4:
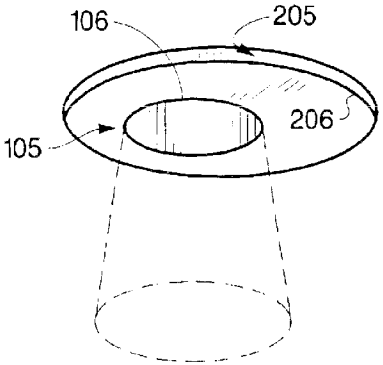
FIG. 4 is a schematic isometric view of an embodiment of an orifice with a counterbore.
Figure 5:
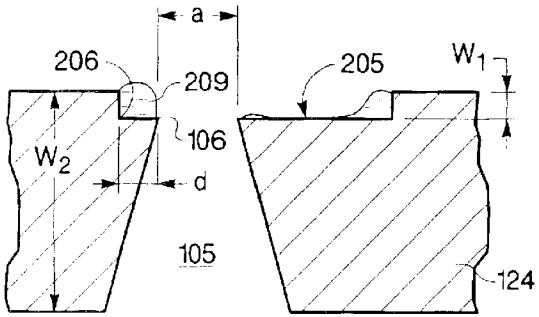
FIG. 5 is a cross-sectional view of the orifice and the counterbore of FIG. 4.

FIG. 4 is an isometric view of the orifice 105 and counterbore 205 of FIG. 3. FIG. 5 is a cross-sectional view of the counterbore 205 of FIG. 4. The counterbore 205 is disposed in the orifice member about a top surface of the orifice 105. The depth w1 of the counterbore is less than the depth or height w2 of the orifice through the orifice member in this embodiment. In one embodiment, the depth w1 of the counterbore is about 0.5 to 10 microns, in a particular embodiment: 1 micron. In one embodiment, the depth w2 of the orifice in the orifice member 124 ranges from about 10 microns to 50 microns. In particular embodiments, the depth w2 is one of 10, 25, 37, and 50 microns.

In one embodiment, during operation of the fluid ejector, when a fluid drop is ejected from the top surface of the orifice 105, some fluid 209 breaks off from the drop to set on the top surface of the orifice, within the counterbore. The fluid 209 within the counter-bore creates puddling, which can effect drop placement error, and thus, print quality in some embodiments.

When puddling occurs in a counter-bore 205 corresponding with a fluid ejection nozzle 105, there are three general scenarios. In a first scenario, there is not enough puddling in the counterbore 205 to affect the direction of the fluid being ejected from nozzle 105. After some amount of firing of the ejection device, a puddle begins to form in the counterbore in a second 'transitional' scenario. In this second 'transitional' scenario, there is an amount of puddling in the counterbore 205 that may affect the direction that fluid is being ejected from the nozzle 105. In one embodiment, this puddle uniformly surrounds the bore, and has no substantial impact on drop trajectory. In another embodiment, there is an asymmetric puddle about the bore, and accordingly, an impact on drop trajectory. Generally, in this asymmetric transition state, the direction of dot placement error is directed toward (a) the highest puddle of fluid 209 in the couterbore 205 surrounding the orifice 105 and/or (b) the fluid first touching the bore. In one embodiment, during this transitional scenario, the entire puddle pulls the drop toward the area of the initially highest puddle, thereby misdirecting the drop substantially consistently in that general direction. The counterbore fills starting at the area of the initially puddle and moving around the nozzle in both directions with two advancing fluid fronts. As the puddle increases in size about the nozzle, the sum of the misdirection remains substantially in the same direction, but the magnitude of the misdirection decreases.

In a third 'steady state' scenario, the puddle expands until the entire counterbore is substantially evenly filled with a layer of fluid approximately 1 $\mu$m thick. After the fluid fronts meet, the misdirection forces from the puddle are substantially equal in all directions, and the puddle no longer affects dot placement.

In one embodiment, the counterbore surface is highly wettable. In another embodiment, the counterbore surface is non-wettable. In yet another embodiment, the counterbore surface is part wettable and part non-wettable. Those of skill in the art appreciate that modification of the counterbore surface wetting can be substantially equivalent to modifications of the counterbore dimensions with respect to the bore.

In one embodiment, the ejected fluid is affected by the puddled fluid in the counterbore such that the ejected fluid may be misdirected in a random direction, i.e. no preferred direction for tail break-off. In most embodiments discussed herein, the second 'transitional' scenario is being considered. In a particular embodiment, it is desired to bias or influence the location of highest fluid puddle, and thus the direction of dot placement error.

In a particular embodiment, fluid 209 builds up more quickly in the narrowest areas of the counterbore 205; i.e. a shortest distance between a top edge 106 of the orifice 105 and an outer edge 206 of the counterbore 205. In one embodiment, the fluid tends to build up in the narrowest area because the bottom surface of the counterbore is not perfectly flat, and tends to have a slightly domed shape. The slightly domed shape causes the top surface of the orifice to be slightly pointed away from the center of the counterbore, which can cause the tail of the drop to break off in this same direction. The top surface of the orifice points toward the narrowest region due to this doming effect. In an additional embodiment, the fluid tends to build up in the narrowest area because the counterbore is generally highly wettable to certain fluids. Fluid in the counterbore spreads out in a thin layer on the bottom surface. The fluid collects, growing thicker, in any groove or other capillary in the bottom surface. In a particular embodiment, fluid collects around the substantially orthogonal outside edge 206 of the counterbore. As this ring of fluid expands, fluid first touches the bore near the area where the bore is closest to the counterbore edge, i.e. The narrowest region.

Figure 6:
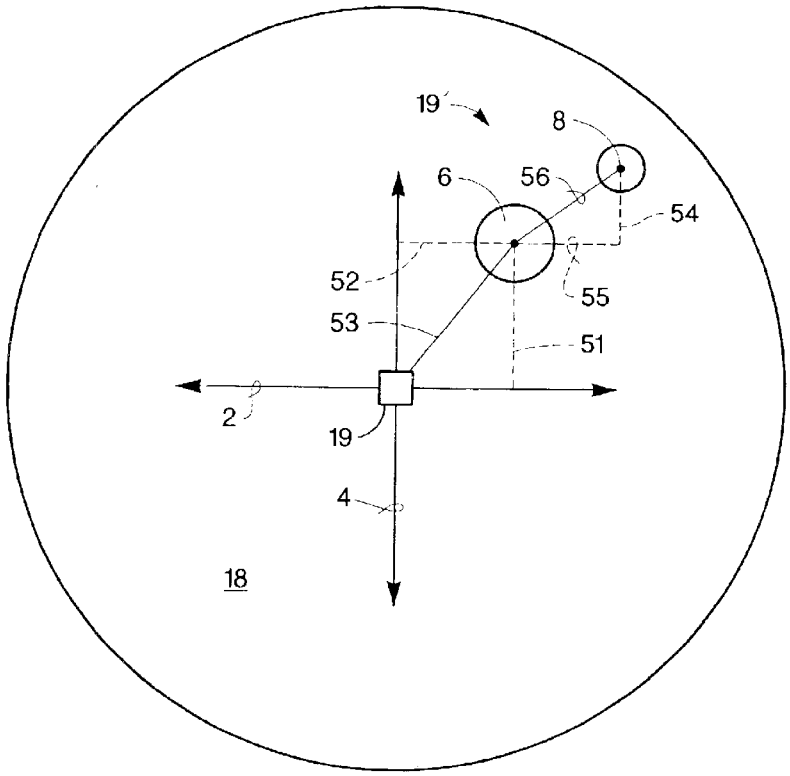
FIG. 6 is a schematic representation of drop placement errors with respect to the scan axis and medium advance axis.

Considering now with reference to FIG. 6, the drop placement error (also known as directionality error or concentricity error) associated with the main and satellite drops ejected from the ejection chamber (such as the firing chamber) 202 is defined as the distance between the actual drop location 19', and the intended pixel location 19. The drop placement error can have a scan axis directionality ("SAD") component in the direction along the scan axis 2, and a medium (such as paper) axis directionality ("PAD") component in the direction along the medium advance axis 4. Where the main 6 and satellite 8 drops are not coincident on the medium 18 (as in FIG. 6), the drop placement error may be determined with respect to a centroidal position of the two drops 6,8. Alternatively, the drop placement error of the drops 6,8 may be measured with respect to the drops 6,8 individually, with the main drop 6 having a drop placement error 53 with a PAD component 51 and a SAD component 52 relative to the intended location 19, and the satellite drop 8 having a drop placement error 56 with a PAD component 54 and a SAD component 55 with respect to the main drop 6.

In embodiments described herein, some types of errors can often be compensated for so as to more closely align the main drop 6 to the desired location 19. However, in some ejection devices the drop placement error of the satellite drop 8 tends to have variable amounts of SAD and PAD error from chamber to chamber, and from drop to drop from the same chamber. This variable drop placement error may become worse at higher scanning speeds.

Because PAD error is typically more perceptible to the human eye than SAD error, in one preferred embodiment PAD error is minimized. Accordingly, the dot placement error has less of an impact on print quality in embodiments where the error is primarily in the scan axis 2.

Alignment of Counterbores to Bores

Figure 7B:
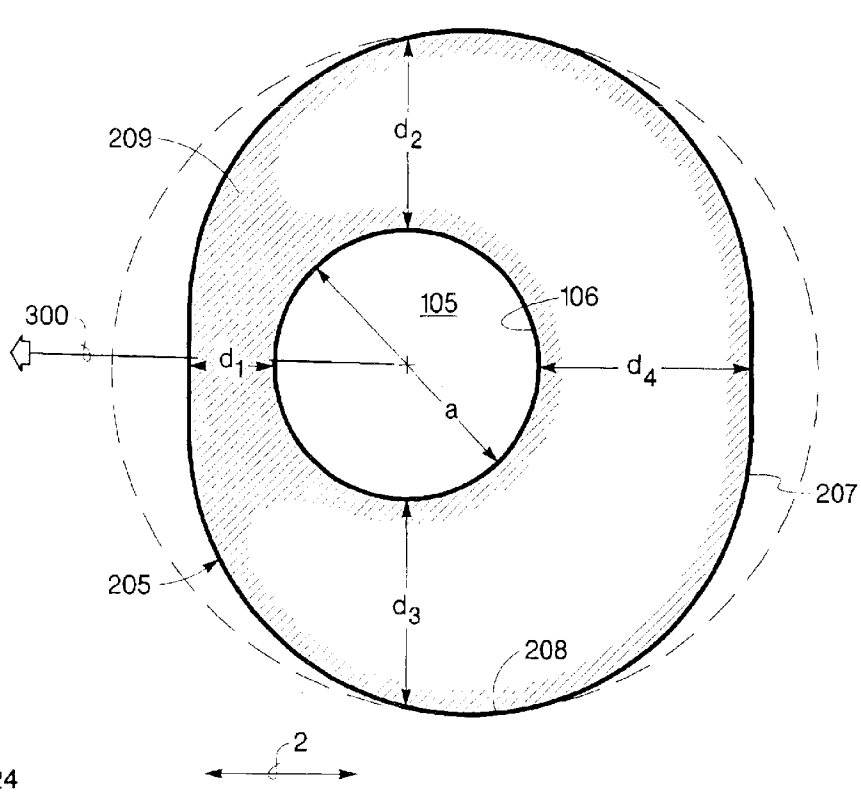
FIG. 7B is a plan view of a counter-bore embodiment shown asymmetrically with a fluid transfer bore.
Figure 7A:
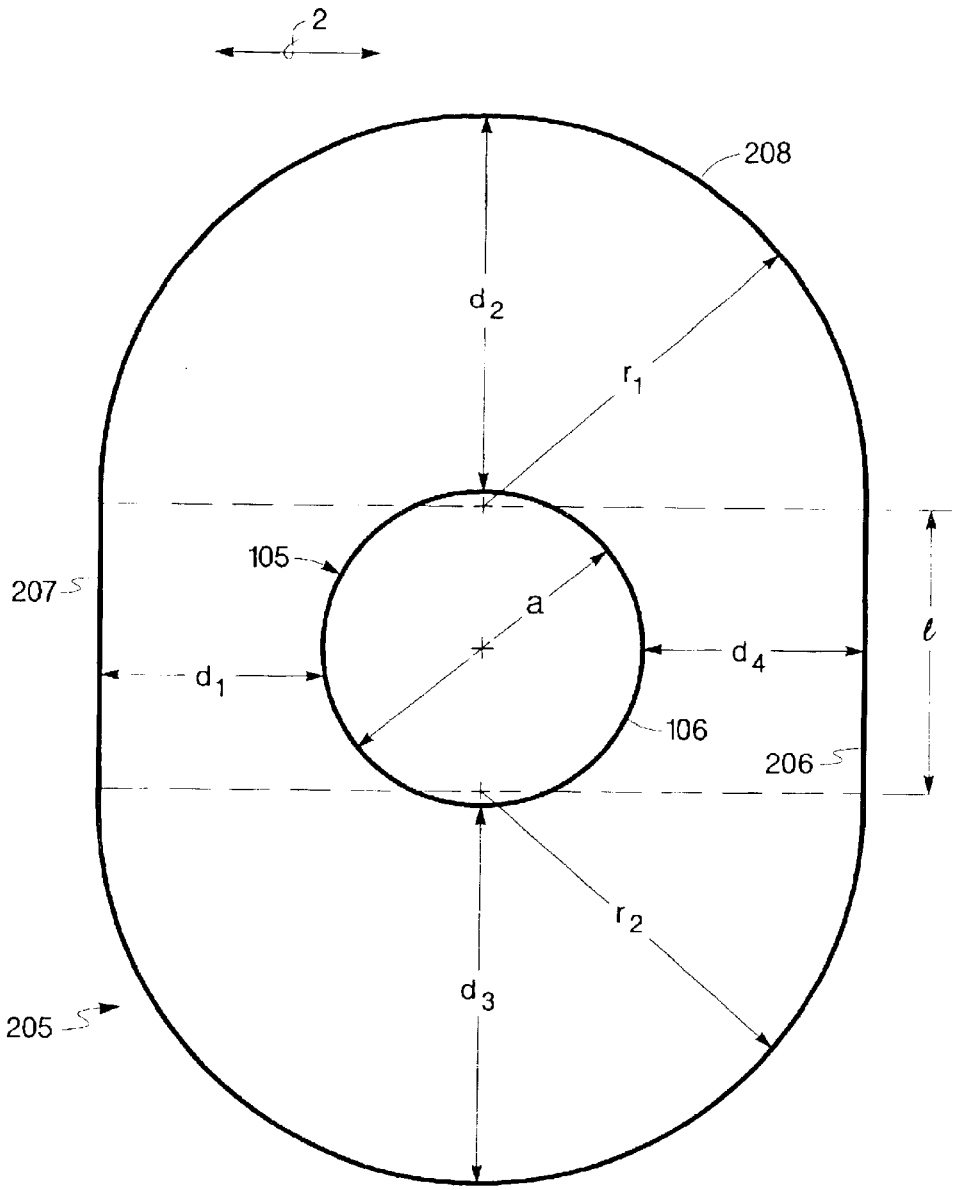
FIG. 7A is a plan view of a counter-bore embodiment shown symmetrically with a fluid transfer bore.

The embodiment of FIG. 7A illustrates a plan view of a counter-bore 205 being substantially symmetrical to a corresponding orifice 105. The counterbore 205 is aligned with the bore 105 when symmetrically placed about the bore, as shown in this embodiment. However, it is often difficult to align the counter-bore with the bore to within a certain tolerance, with some embodiments. FIG. 7B illustrates a plan view of an embodiment with a counter-bore 205 being asymmetrical to the corresponding orifice 105.

In one embodiment, the distance between the actual location of the counterbore 205 with respect to the bore 105, and the intended location of the counterbore with respect to the bore is considered an offset in radial alignment. In one counterbore embodiment, a radial alignment tolerance is about 0 to 10 microns. In another counterbore embodiment, the radial alignment tolerance is about 7 microns. In yet another counterbore embodiment, the tolerance is less than about 5 microns. One skilled in the art would understand that tolerances outside this range are within the purview of these embodiments. In several embodiments, the SAD and PAD errors are affected by the degree or amount of misalignment of the counterbore 205 with respect to the bore 105. In one embodiment, this misalignment is substantially the same as the amount of counterbore radial offset. In the embodiment of FIG. 7A, there is substantially no counterbore/bore misalignment. As the counterbore 205 of FIG. 7A fills with fluid 209, the fluid is filled about the bore 105 with substantial symmetry. This fluidic symmetry, in one embodiment in the "transitional" state, renders a counterbore without any significant fluid high spots. Accordingly, the drop placement upon the media is substantially unaffected by the fluid in the counterbore, and thus, there are no significant SAD or PAD errors in this embodiment.

Counter-Bore Embodiments

In one embodiment, the shape and size of the counterbore 205 depends upon the shape and size of the bore 105. The counterbore and bore are configured in size and shape such that a fluid puddle is formed in the narrowest region to maximise drop placement accuracy and/or precision, such that print quality is maximized in one embodiment.

In the embodiments shown in FIGS. 7A and 7B, the counter-bore 205 is stadium shaped. In another embodiment, the outer edges 206 of the counter-bore 205 are shaped as an oval race track. In yet another embodiment, the counter-bore 205 is oblong. In another embodiment, the counter bore 205 is substantially a circle with multiple substantially flat spots 207 in edges 206 of the counter-bore. In one embodiment, one flat spot 207 is substantially in the scan axis 2 direction. In another embodiment, the flat spot is substantially aligned with the medium axis 4 direction.

As shown in the embodiments of FIGS. 7A and 7B, the counterbore has straight or flat sides 207 and rounded ends 208. In another embodiment, the sides 207 are curvilinear. In yet another embodiment, the counter-bore is a shape with narrow sides in first direction, and elongated sides in a second direction perpendicular to the first direction. In one embodiment, the counter-bore is one of race-track shaped, rectangular, and hourglass shaped.

In the embodiment of FIGS. 7A and 7B, the counterbore is two semi-circles connected by a bridge. The end semi-circles have radii of curvature of r1 and r2, respectively. The radii of curvature r1 and r2 range from between about 17 and 19 microns (the diameter is about 34 to 37 microns). In one embodiment, r1 and r2 are substantially the same length. In another embodiment, r1 and r2 are different lengths. The range of radii r1, r2 is about 1.5 to about 5 times the nozzle/bore diameter, in a particular embodiment. In a more particular embodiment, the radii of curvature r1 and r2 is about three times the nozzle diameter.

In one embodiment, at least a substantial portion of the fluid-transfer bore 105 is within the bridge section of the counterbore 205 (as shown best in FIG. 7A). The bridge in between the two semi-circles has a length 1 that is about 5 microns in one embodiment. In a particular embodiment, the side length 1 is about 0.25 to about 1.5 times the nozzle diameter. In a more particular embodiment, the side length is about 0.5 times the nozzle diameter. In one embodiment, the counter-shape has a surface area of about 1260 square microns.

In the embodiments of FIGS. 7A and 7B, between the top edge 106 of the orifice and outer edges 206 of the counter-bore is the bottom of the counterbore. A distance "d" is measured along the bottom of the counterbore between the top edge 106 of the orifice 105 and the closest corresponding outer edge 206 of the counterbore 205. In the embodiment shown in FIG. 7A, d1 and d4 are substantially aligned with the scan axis (or short axis), while d2 and d3 are substantially aligned with the medium axis (or long axis). In the embodiment shown, distances d1 and d4 are substantially the same, and are in the range of about 6 to 16 microns. In this embodiment, distances d2 and d3 are substantially the same, and are in the range of about 8.5 to 18.5 microns.

In some embodiments, the counter-bore is symmetrical in the scan axis 2 direction and/or the medium axis 4 direction. For example, in one embodiment, d1 is substantially the same as d4, and the bore is substantially symmetrical to the counterbore in the scan axis direction. In another embodiment, d2 is substantially the same as d3, and the bore is substantially symmetrical to the counterbore in the medium axis direction. In some embodiments, the counterbore is asymmetrical in the scan axis 2 direction and/or the medium axis 4 direction. For example, d1 is not substantially the same as d4; and/or d2 is not substantially the same as d3.

In the embodiment of FIG. 7B, the bore 105 is asymmetrical with the counterbore 205 in both the scan and medium axes. The fluid-transfer bore (or orifice) 105 is non-concentric with respect to the counterbore 205 in this embodiment. In embodiments of the present invention, the direction or misdirection of the fluid caused by the puddling of the fluid 209 in the narrowest region is biased or influenced by the asymmetry of the counterbore relative to the bore. In particular embodiments, the narrowest region of the counterbore bottom (and corresponding puddle) is in the scan axis direction.

An edge 206 of the counterbore 205 is closest to an edge 106 of the fluid-transfer bore 105 in a first direction, in the first region. In the embodiment shown in FIG. 7B, distances d1 and d4 are each shorter than distances d2 or d3, and distance d4 is longer than d1. In this embodiment, the narrowest region (closest edges 106, 206) is therefore located along the distance d1, with the first direction being substantially in the scan axis 2 direction. Consequently, the counterbore region of d1 fills up more quickly with fluid 209 than in the other directions. Accordingly, in one embodiment where the puddling is in the transitional state, the misdirection 300 is substantially towards d1, as shown in FIG. 7B.

In embodiments of the present invention, the shape of the counterbore allows the capillary action of the fluid to bias any puddling-related misdirection in the least harmful directions, which allows a much larger tolerance for bore-counterbore alignments and thus, a more robust product and higher yield. Because the narrowest regions of this embodiment are in the scan axis direction, where errors may be unavoidable, dot placement errors are thereby biased substantially in the scan axis direction in this embodiment. Therefore, the counterbores 205 have increased robustness to misalignment in the medium axis 4, and less robustness to misalignment in the scan axis 2 direction, in this embodiment.

In other embodiments, the first direction (where edges 106, 206 are closest) is in any direction, including in the direction of the medium axis or a combination of the scan and medium axes. In these other embodiments, the ejected fluid is biased in primarily the medium axis 4 or in both the scan and medium axes. In one of these other embodiments, d2 is the shortest distance between edges 106, 206 and the misdirection 300 of the dot placement is biased towards the area of d2. In another embodiment, d3 is shortest and the misdirection 300 is biased towards d3. In another embodiment, d4 is shortest and the misdirection 300 is biased towards d4.

It is therefore to be understood that this invention may be practiced otherwise than as specifically described. For example, the present invention is not limited to thermally actuated fluid ejection devices, but may also include, for example, piezoelectric activated fluid ejection devices, and other mechanically actuated printheads, as well as other fluid ejection devices. Thus, the present embodiments of the invention should be considered in all respects as illustrative and not restrictive, the scope of the invention to be indicated by the appended claims rather than the foregoing description. Where the claims recite "a" or "a first" element of the equivalent thereof, such claims should be understood to include incorporation of one or more such elements, neither requiring nor excluding two or more such elements.

What is claimed is:

1. A fluid ejection device comprising:

a substrate including a fluid ejector thereon; and an orifice member positioned over said substrate, said orifice member having a fluid-transfer bore extending therethrough and corresponding to the fluid ejector, said orifice member further including;

a substantially stadium-shaped counter-bore in a top surface of the orifice member about the fluid-transfer bore, wherein a bottom surface of the counter-bore has a slightly domed shaped.

2. The device of claim 1 wherein the stadium-shaped counter-bore is non-concentric with the fluid-transfer bore.

3. The device of claim 2 wherein the counter-bore has substantially straight sides and substantially rounded ends, wherein an edge of the fluid-transfer bore is nearest in proximity to the counter-bore at the straight sides.

4. The device of claim 1 wherein the counter-bore has substantially straight sides and substantially rounded ends.

5. The device of claim 4 wherein the rounded ends each have a radius between about 17 and 19 microns.

6. The device of claim 4 wherein the stadium-shaped counter-bore is two substantially semi-circle sections connected by a bridge section.

7. The device of claim 6 wherein the bridge section is about 5 microns in length in between the two semi-circle sections.

8. The device of claim 6 wherein at least a substantial portion of the fluid-transfer bore is within the bridge section of the counter-bore.

9. The device of claim 1 wherein the fluid-transfer bore is substantially circular.

10. The device of claim 1 wherein a distance between edges of the fluid-transfer bore and the counter-bore in a first axis is shorter than a distance between the edges of the fluid transfer bore and the counter-bore in a second perpendicular axis.

11. The device of claim 10 wherein the first axis is at least one of a scan axis and a medium axis.

12. The fluid ejection device of claim 1 wherein the counter-bore is positioned symmetrically about the fluid-transfer bore to within a radial alignment tolerance of at most about 5 to 10 microns.

13. The fluid ejection device of claim 1 wherein the counter-bore includes a circular shape with a substantially flat side.

14. The fluid ejection device of claim wherein the substantially flat side is perpendicular to the scan axis.

15. A component for a print cartridge comprising:

a substrate including a fluid ejector thereon;

an orifice member positioned over said substrate, said orifice member having an orifice extending therethrough, wherein the orifice corresponds to the fluid ejector, wherein said orifice member includes a counter-bore about the fluid-transfer bore, wherein a narrow region includes a shortest distance between a top edge of the orifice and an inner edge of the counter-bore, wherein the counter-bore includes a shape with narrow, substantially straight sides in a first axis direction, and elongated, substantially curvilinear sides in a second axis direction perpendicular to the first axis direction; and means for forming an asymmetric fluid puddle about the orifice substantially in the narrow region.

16. The component of claim 15 wherein the narrow region is in a scan axis direction.

17. The component of claim 15 wherein the counter-bore is one of race-track shaped, and hourglass shaped.

18. A method of biasing a direction of a fluid ejection drop comprising:

forming a fluid ejector upon a substrate;

positioning an orifice member over said substrate, wherein an orifice in the orifice member corresponds to the fluid ejector;

forming a counter-bore about the orifice, wherein the counter-bore includes a shape with narrow, substantially straight sides in a first axis direction, and elongated, substantially curvilinear sides in a second axis direction perpendicular to the first axis direction; and forming an asymmetric fluid puddle about the orifice substantially at a predetermined location within a narrow region including a shortest distance between a top edge of the orifice and an inner edge of the counter-bore to maximize drop placement accuracy.

19. The component of claim 15 wherein the counter-bore includes a circular shape with a substantially flat side at the narrow region.

20. The component of claim 19 wherein the substantially flat side is perpendicular to the scan axis.

21. A method comprising:

forming a fluid ejector upon a substrate;

positioning an orifice member over said substrate, wherein an orifice in the orifice member corresponds to the fluid ejector;

forming a counter-bore about the orifice, wherein the counter-bore is a shape with narrow, substantially straight sides in a scan axis direction, and elongated, substantially curvilinear sides in a second axis direction perpendicular to the scan axis direction; and forming a fluid puddle between a top edge of the orifice and an inner edge of the counter-bore to bias a fluid drop in the scan axis direction.

22. A method comprising:

forming a fluid ejector upon a substrate;

positioning an orifice member over said substrate, wherein an orifice in the orifice member corresponds to the fluid ejector;

forming a counter-bore about the orifice, wherein the counter-bore is a shape with narrow, substantially straight sides in a scan axis direction, and elongated, substantially curvilinear sides in a second axis direction perpendicular to the scan axis direction; and forming a fluid puddle between a top edge of the orifice and an inner edge of the counter-bore to bias a fluid drop in the scan axis direction.

23. The method of claim 22 wherein the puddle is asymmetric about the orifice, wherein a highest portion of the puddle is in a narrow region including a shortest distance between the top edge of the orifice and the inner edge of the counter-bore.

24. The method of claim 21 further comprising forming a highest fluid puddle in the narrow region between edges of the counter-bore and the orifice in that predetermined locations.

25. The method of claim 24 wherein the narrow region corresponds with a narrow section of the counter-bore, wherein the counter-bore has the elongated sides in the second axis direction perpendicular to the narrow section.

26. The method of claim 22 wherein the counter-bore is one of race-track shaped, rectangular, and hourglass shaped.

27. A method of aligning a counter-bore and a bore of a fluid ejection device comprising:

forming a fluid ejector upon a substrate;

positioning an orifice member over said substrate, wherein a bore in the orifice member corresponds to the fluid ejector;

forming a substantially race-track shaped counter-bore symmetrically about the bore to within a radial alignment tolerance of at most about 5 to 10 microns.

28. The method of claim 27 wherein the tolerance is at most about 7 microns.

29. The method of claim 27 wherein a drop placement error direction is substantially in the scan axis direction.

30. A fluid ejection device comprising:

a fluid ejector disposed upon a substrate;

an orifice member over said substrate, wherein an orifice in the orifice member corresponds to the fluid ejector;

a counter-bore about the orifice and within the orifice member, wherein the counter-bore has narrow substantially straight sides in a first scan axis direction; wherein the counter-bore has curvilinear elongated sides in a second axis direction; and means for forming an asymmetric fluid puddle about the orifice.

31. The fluid ejection device of claim 30 wherein the orifice member comprises a fluid-transfer bore including an edge that is nearest in proximity to the counter-bore at the narrow substantially straight sides.

32. The fluid ejection device of claim 31 wherein the fluid-transfer bore is substantially circular.

33. The fluid ejection device of claim 31 wherein a shortest distance between the edges of the fluid-transfer bore and the counter-bore in the first scan axis direction is to accommodate the asymmetric fluid puddle about the fluid-transfer bore.

34. The fluid ejection device of claim 30 wherein the elongated sides of the counter-bore have rounded ends with a radius between about 17 and 19 microns.

* * * * *

UNITED STATES PATENT AND TRADEMARK OFFICE

CERTIFICATE OF CORRECTION

PATENT NO. : 6,938,988 B2
APPLICATION NO. : 10/361352
DATED : September 6, 2005
INVENTOR(S) : Garrett E. Clark et al.

It is certified that error appears in the above-identified patent and that said Letters Patent is hereby corrected as shown below:

In column 3, line 38, delete “24” and insert -- 124 --, therefor.

In column 4, line 10, delete “effect” and insert -- affect --, therefor.

In column 4, line 28, delete “couterbore” and insert -- counterbore --, therefor.

In column 4, line 33, after “initially” insert -- highest --.

In column 6, line 60, delete “counter-shape” and insert -- counter-bore shape --, therefor.

In column 8, line 22, in Claim 1, delete “including;” and insert -- including: --, therefor.

In column 8, line 26, in Claim 1, delete “shaped.” and insert -- shape. --, therefor.

In column 8, line 62, in Claim 14, delete “claim” and insert -- claim 13 --, therefor.

In column 9, lines 17-34, Claim 18, delete “18. A method of biasing a direction of a fluid ejection drop comprising: forming a fluid ejector upon a substrate; positioning an orifice member over said substrate, wherein an orifice in the orifice member corresponds to the fluid ejector; forming a counter-bore about the orifice, wherein the counter-bore includes a shape with narrow, substantially straight sides in a first axis direction, and elongated, substantially curvilinear sides in a second axis direction perpendicular to the first axis direction; and forming an asymmetric fluid puddle about the orifice substantially at a predetermined location within a narrow region including a shortest distance between a top edge of the orifice and an inner edge of the counter-bore to maximize drop placement accuracy.” and insert -- 18. The component of claim 15 wherein the counter-bore is asymmetrical with the orifice. --, therefor.

In column 9, lines 40-53, Claim 21, delete “21. A method comprising: forming a fluid ejector upon a substrate; positioning an orifice member over said substrate, wherein an orifice in the orifice member corresponds to the fluid ejector; forming a counter-bore about the orifice, wherein the counter-bore is a shape with narrow, substantially straight sides in a scan axis direction, and elongated, substantially curvilinear sides in a second axis direction perpendicular to the scan axis direction; and forming a fluid puddle

UNITED STATES PATENT AND TRADEMARK OFFICE

CERTIFICATE OF CORRECTION

PATENT NO. : 6,938,988 B2
APPLICATION NO. : 10/361352
DATED : September 6, 2005
INVENTOR(S) : Garrett E. Clark et al.

It is certified that error appears in the above-identified patent and that said Letters Patent is hereby corrected as shown below:

between a top edge of the orifice and an inner edge of the counter-bore to bias a fluid drop in the scan axis direction." and insert -- 21. A method of biasing a direction of a fluid ejection drop comprising: forming a fluid ejector upon a substrate; positioning an orifice member over said substrate, wherein an orifice in the orifice member corresponds to the fluid ejector; forming a counter-bore about the orifice, wherein the counter-bore includes a shape with narrow, substantially straight sides in a first axis direction, and elongated, substantially curvilinear sides in a second axis direction perpendicular to the first axis direction; and forming an asymmetric fluid puddle about the orifice substantially at a predetermined location within a narrow region including a shortest distance between a top edge of the orifice and an inner edge of the counter-bore to maximize drop placement accuracy. --, therefor.

In column 10, lines 13-14, in Claim 24, delete "locations." and insert -- location. --, therefor.

In column 10, line 41, in Claim 30, delete "direction;" and insert -- direction, --, therefor.

Signed and Sealed this

Twenty-ninth Day of September, 2009

David J. Kappos

David J. Kappos
*Director of the United States Patent and Trademark Office*